US007197855B2

(12) United States Patent
Della Pepa

(10) Patent No.: US 7,197,855 B2
(45) Date of Patent: Apr. 3, 2007

(54) PAVING SYSTEM FOR FLOOR TILES

(75) Inventor: Tomas Della Pepa, Limburger Hof (DE)

(73) Assignee: Hans Meyer, Ludwigshafen (DE)

( * ) Notice: Subject to any disclaimer, the term of this patent is extended or adjusted under 35 U.S.C. 154(b) by 443 days.

(21) Appl. No.: 10/752,591

(22) Filed: Jan. 8, 2004

(65) Prior Publication Data

US 2004/0139679 A1 Jul. 22, 2004

Related U.S. Application Data

(63) Continuation of application No. PCT/DE02/04023, filed on Oct. 28, 2002.

(51) Int. Cl.
*E04C 2/38* (2006.01)

(52) U.S. Cl. ..... 52/460; 52/465; 52/764; 52/312; 52/591.4; 52/578; 52/656.1; 52/653.1

(58) Field of Classification Search ..... 52/384, 52/385, 387, 390–392, 747.11, 403.1, 781.3, 52/475.1, 455–456, 480, 762, 263, 311.2, 52/506.07, 506.08, 508, 510, 666–667, 177, 52/591.4, 591.5, 592.1, 592.2, 580–581, 52/588.1, 582.1, 586.1, 586.2, 585.1, 126.1, 52/126.5, 460–471, 763–781, 656.1, 645, 52/653.1

See application file for complete search history.

(56) References Cited

U.S. PATENT DOCUMENTS

| | | | | | |
|---|---|---|---|---|---|
| 2,303,745 | A | | 12/1942 | Karreman | |
| 3,016,316 | A | | 1/1962 | Olson | |
| 3,339,329 | A | * | 9/1967 | Berg | 52/395 |
| 3,504,472 | A | * | 4/1970 | Clement | 52/477 |
| 3,535,844 | A | | 10/1970 | Glaros | |
| 3,553,921 | A | | 1/1971 | Breistein | |
| 3,723,233 | A | | 3/1973 | Bourke | |
| 4,067,155 | A | * | 1/1978 | Ruff et al. | 52/105 |
| 4,468,910 | A | * | 9/1984 | Morrison | 52/591.2 |
| 4,550,543 | A | * | 11/1985 | Valenzano | 52/309.7 |
| 4,590,731 | A | * | 5/1986 | DeGooyer | 52/581 |
| 4,640,850 | A | | 2/1987 | Marocco | |
| 4,664,955 | A | | 5/1987 | Clem | |
| 4,744,194 | A | * | 5/1988 | Yasuyoshi | 52/747.11 |
| 4,840,825 | A | | 6/1989 | Aristodimou | |
| 4,931,331 | A | | 6/1990 | Owens | |
| 5,418,036 | A | * | 5/1995 | Tokikawa et al. | 428/120 |
| 5,611,185 | A | * | 3/1997 | Wilz | 52/506.07 |
| 5,638,653 | A | * | 6/1997 | Rossi | 52/511 |
| 5,899,040 | A | | 5/1999 | Cerrato | |
| 5,918,437 | A | * | 7/1999 | Dobija | 52/506.01 |

(Continued)

FOREIGN PATENT DOCUMENTS

| | | |
|---|---|---|
| DE | 2 246 778 | 9/1972 |
| DE | 30 36 339 | 5/1982 |
| DE | 200 09 717 | 11/2000 |
| DE | 199 62 812 | 6/2001 |
| EP | 0 256 189 | 2/1988 |
| EP | 0 544 604 | 6/1993 |
| EP | 1 242 701 | 4/2000 |
| WO | 99/41814 | 8/1999 |
| WO | WO 00/08274 | 2/2000 |
| WO | 01/48331 | 4/2000 |

*Primary Examiner*—Jeanette Chapman
(74) *Attorney, Agent, or Firm*—Dykema Gossett PLLC

(57) ABSTRACT

The invention relates to a paving system for tiles, especially flagstones, for paving ceilings, walls, or floors, in which each tile is provided with a paving frame on which the tile rests over at least part of its area. The paving frames comprise, on each of two adjacent (intersecting) limbs, a fin for the accommodation of a rubber-elastic sealing profile that defines the width of the seam.

25 Claims, 10 Drawing Sheets

U.S. PATENT DOCUMENTS

| | | | | |
|---|---|---|---|---|
| 6,021,615 | A | 2/2000 | Brown | |
| 6,230,385 | B1 * | 5/2001 | Nelson | 29/450 |
| 6,247,286 | B1 | 6/2001 | Heyns | |
| 6,260,326 | B1 * | 7/2001 | Muller-Hartburg | 52/601 |
| 6,332,733 | B1 | 12/2001 | Hamberger et al. | |
| 6,357,195 | B1 * | 3/2002 | Chen | 52/668 |
| 6,647,684 | B1 * | 11/2003 | Gank | 52/385 |
| 6,694,689 | B1 * | 2/2004 | Scott et al. | 52/392 |
| 6,862,855 | B1 * | 3/2005 | Milum et al. | 52/384 |
| 6,990,777 | B2 * | 1/2006 | Poliacek et al. | 52/384 |

* cited by examiner

PAVING SYSTEM FOR FLOOR TILES

CROSS REFERENCE TO RELATED APPLICATION

This is a continuation of International Application PCT/DE02/04023 filed Oct. 28, 2002, which designated the U.S. All priorities are claimed.

BACKGROUND OF INVENTION a. Field of Invention

The invention relates to a paving system for floor tiles and is particularly suitable for stoneware tiles, flagstones, and blocks of wood.

b. Description of Related Art

Floor tiles, when in the form of stoneware or ceramic tiles, are usually laid by means of a suitable adhesive on an appropriately prepared surface, eg, a smooth coat, the width of the seams being usually determined by the insertion of cross-shaped gap definers, and the resulting seams must be subsequently pointed. Paving or tile-laying is comparatively elaborate both as regards the tools required and with respect to the necessary materials, and, in addition, it demands relatively high mechanical skill on the part of the paver. Furthermore, the time lapse required before the paving may be walked on is long. Another drawback may be seen to be the fact that paving laid by this method cannot be readily removed, ie not without destroying the tiles.

In the case of blocks of wood, for example parquetry or laminated blocks, such as are used for floor coverings, is it known to provide a groove on one pair of the intersecting sides of the block and a matching tongue on the other two sides of the block. During the paving operation, the blocks are pushed together so that a groove is engaged by a tongue, in which position they are then adhesively joined. Here again, the floor covering cannot be removed at a later date without destroying the blocks.

DE 199 62 812 and DE 200 09 717 U1 disclose stone tiles having a laying frame and a gasket.

DE 199 62 812 A1 discloses the provision of the edges of tiles for paving floors and walls with an edge profile, which can be bonded to the tiles. The edge profiles are formed such that a first limb is provided for the tile to rest on and a second limb is provided to bear against the all-round edge surface of the tile. Furthermore, a projection is provided on the side of the tile remote from the limb extending along the edge of the tile, which, together with the projection on the adjacent tile, governs the specified minimum width of the seam. Into the seam formed by two mirror-symmetrically disposed edge profiles there is inserted a topping profile. This topping profile is prevented from slipping out by the engagement of teeth. A non-slip damping layer can be provided on the tile, the marginal area of the underside of the tile being left free, however, because the edge profiles bear against the tile over this area all round the tile. The tiles, which are supplied with the edge profiles already in position, are laid out on a floor surface in such a manner that the projections abut each other.

According to DE 200 09 717 U1 it is known to provide a substantially T-shaped supporting profile, between two abutting tiles, which profile has two lateral supporting webs for supporting a tile and a middle retaining section with a groove for holding a gasket. The retaining section extends along a portion of the edge of the tile and the gasket is formed such that it presents a number of consecutive sealing faces toward the top surface of the tile. Between the tile and the lateral supporting web there is provided a sealing tape, which prevents any water that may have passed through the gasket from escaping at the underside of the tile. Furthermore, a guide web can be provided in the region of the supporting web for the formation of effluent channels.

It is an object of the present invention to provide a paving system which enables paving to be carried out relatively easily, ie by unskilled persons if necessary. The paving system is intended to be particularly suitable for natural flagstones of, say, granite, marble, etc. or for wooden blocks or tiles of ceramics or other materials. Moreover, it is intended to ensure that the paving can be removed, if required, without causing damage to the individual tiles.

SUMMARY OF INVENTION

The aforementioned drawbacks can be avoided with the paving system proposed by the invention. Each tile rests, at least over part of the surface of its underside, on a paving frame exhibiting supporting profiles having paving areas, and the paving frame exhibits a fin projecting beyond the paving surface toward the top side the tile, which fin extends along at least part of the edge of the tile toward the top side of the tile. The paving frames can be interconnected. The fin is provided on only two adjacent supporting profiles whereas the other two supporting profiles have a paving area having no fin. The first supporting profiles exhibit at least one locking extension extending beyond the tile, whilst the other two supporting profiles exhibit at least one locking extension situated underneath the tile, and in each case one supporting profile cooperates with a different supporting profile.

In the case of square or rectangular tiles, the paving frame has a total of four supporting profiles, our special embodiment of the connection between them making it possible to move parallel rows of paved tiles. By this means it is possible to pave the tiles in staggered relationship to each other. In this case, a corner of one tile will not meet three other corners of other tiles but instead two corners will abut the side edge of the adjacent row of tiles.

The rubber seam sealant used to seal the individual tiles gives a precise and consistent seam pattern, and the resulting impermeability thereof to water is very convincing.

The invention dispenses with the need for expansion joints even when large areas are being paved since with this floating paving there is no fixed anchorage to the substrate. Thus the risk of cracks forming in the floor covering or in an individual tile, such as can occur when tiles are adhesively bonded to plaster floors, does not exist. Furthermore, adhesives are no longer necessary for paving.

Special advantages arise when paving with high-quality tiles, such as granite flagstones or similar tiles, since the additional cost of the paving system is less significant in terms of the price per unit, and a much more important advantage is that mistakes during paving are avoided even by poorly trained paving personnel. Moreover, the paving costs are considerably lower.

On account of the floating paving method, it is possible, when restoring old buildings containing boarded floors, to pave granite floors quickly and cheaply on the existing wooden constructions without much preparatory work. In addition, the invention makes it possible to pave the floors of prefabricated timber houses with granite and natural stone.

The very frequently occurring problem of insufficient footfall-sound-insulation in existing plaster floors, with which acoustic refraction frequently occurs as a result of improper paving, no longer occurs when use is made of the paving system of the invention in conjunction with footfall-sound-insulating material, and optimal insulation is guaranteed. To this end, the underside of the paving frames is provided with footfall-sound-insulating material.

In addition to the paving system itself, the invention relates to a tile for use in the paving system and also to the floor covering produced with the aid of the paving system or by the use of said tile. Another object of the invention is a paving frame for a tile. Advantageous developments are described in the respective sub-claims.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Working examples:

The working examples illustrated involve floor coverings comprising a number of flagstones, eg, granite flagstones, that abut each other in rows laid out on a substrate, eg, a smooth coating or boarded flooring, so as to float on intermediate spacing material.

Figure 1:
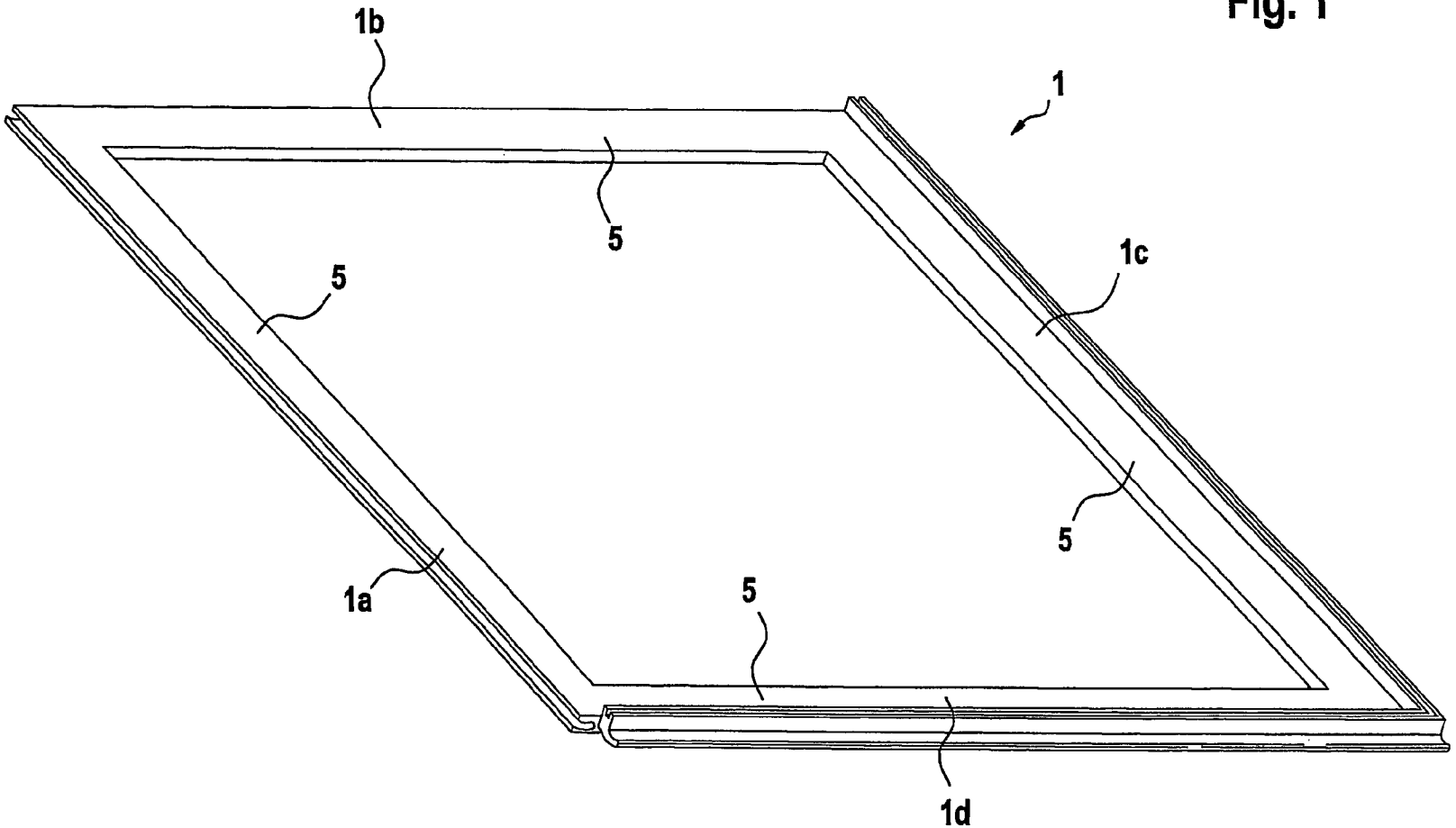
FIG. 1 shows a pre-formed frame to accommodate a tile.

FIG. 1 is a perspective view of a square frame 1 to accommodate a tile (not shown in this figure), eg, a granite flagstone. Frame 1 is of a plastics material and is pre-formed; it may consist of an undivided injection molding or, alternatively, of individual elements made from extruded profiled material. The material used may be recycled plastics material.

Figure 4:
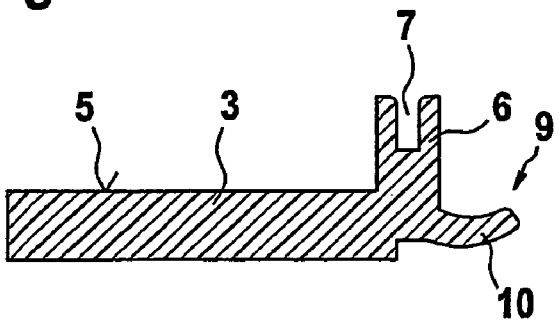
FIG. 4 shows a (male) part of the profiled frame element in cross-section.
Figure 5:
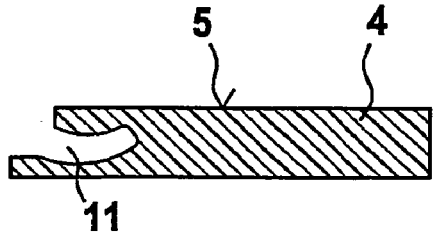
FIG. 5 shows a (female) part of the profiled frame element in cross-section.

Of the four limbs 1*a* to 1*d* of frame 1, two adjacent limbs 1*c*, 1*d* have a plug-type profile 3 which is shown in FIG. 4 in cross-section. The other two limbs 1*a*, 1*b* have a socket-type profile 4 as shown in FIG. 5 in cross-section. All four limbs 1*a* to 1*d* have a paving strip 5, on which the tile 2 to be placed in the frame rests in the paved state.

Figure 2A:
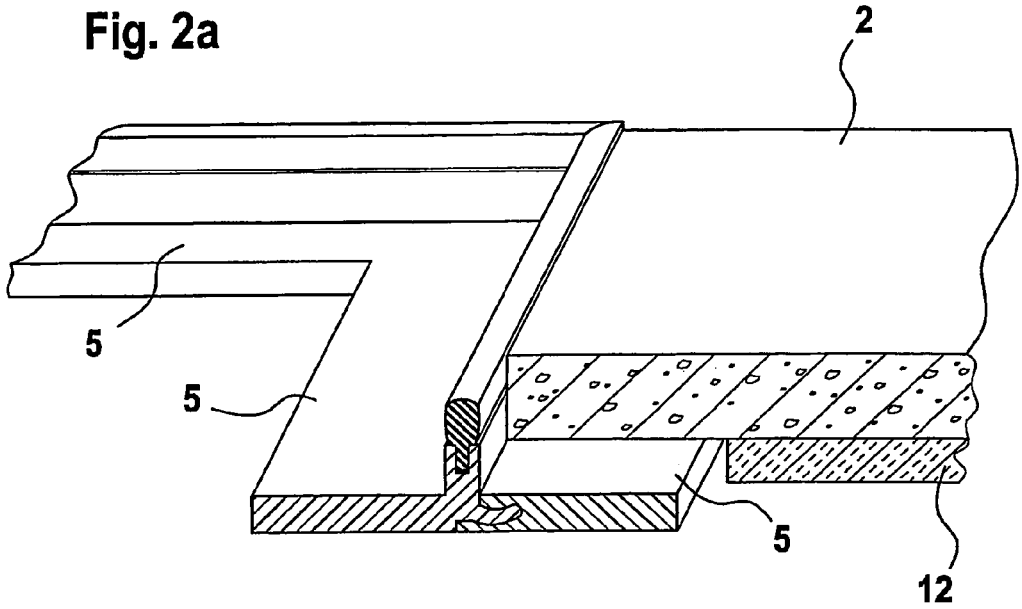
FIG. 2*a* shows a cross-section of a floor covering with a tile in position.

FIG. 2*a* illustrates such a tile 2 resting on paving strip 5 with the socket-type profile 4. The width the paving strip 5 is, for a tile width of 305 mm, advantageously 20 mm.

The distance between the paving substrate (floor coating) and the paved tile 2, as specified by the height or thickness of the paving strip 5 of the frame 1, may advantageously be utilized for the insertion of footfall-sound-insulating material 12. The thickness of the footfall-sound-insulating material 12 must be such that it is equal to said distance between tile and paving substrate only when under load. The footfall-sound-insulating material 12 is advantageously stuck to the underside of the tile. In this way the problem of reverberation, as is met in the parquetry trade, is reliably avoided.

Figure 2B:
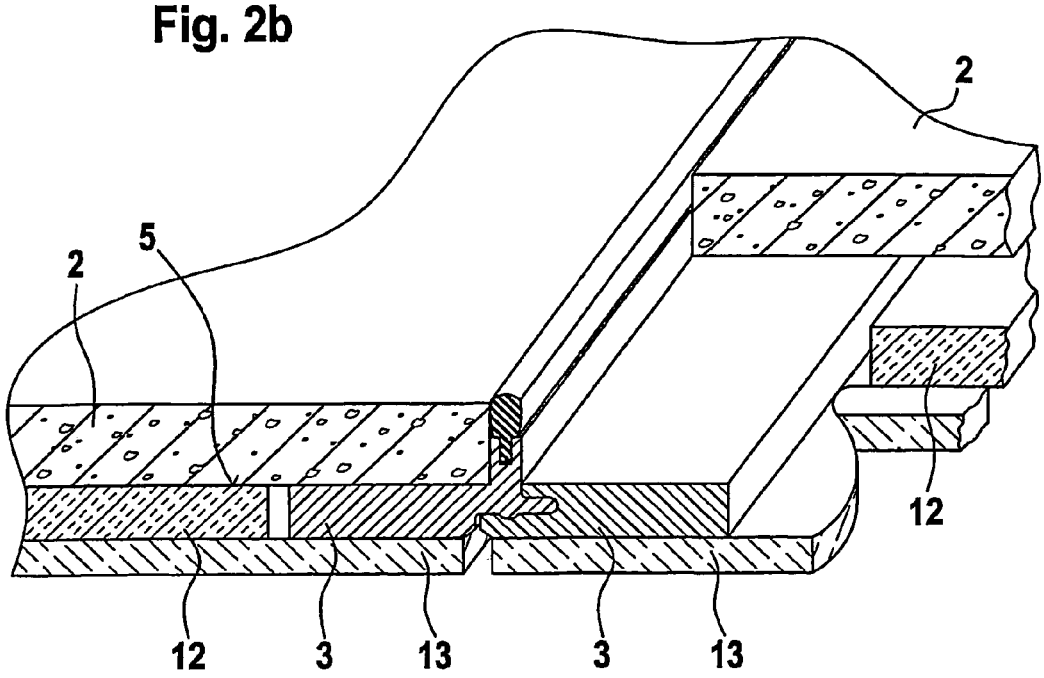
FIG. 2*b* shows another cross-section of a floor covering with two tiles in position.

FIG. 2*b* shows two tiles in paved position, of which, however, the right-hand tile 2 has been moved back for illustration purposes. The underside of tile 2 rests, in its marginal area, on the paving strip 5 and is adhesively bonded thereto.

Unlike FIG. 2*a* the footfall-sound-insulating material 12 extends not only to near the paving strip 5 but also beneath this, so that insulation takes place in the region of the paving strip 5 itself. This is indicated by broken lines, the area below paving strip 5 being designated by the reference numeral 13.

If slight unevenness or roughness in the surface of the paving substrate has to be taken into consideration, eg, in the case of a very rough plaster floor, it may be advantageous to additionally stick a resilient foamed underlay (not shown) to the underside of frame 1. This underlay can be attached by adhesive applied in spots or over the entire area.

Figure 6:
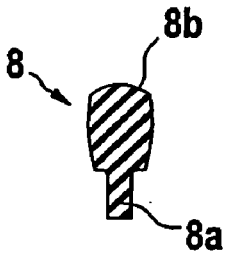
FIG. 6 is a cross-section of a gasket for fitting into one part of the profiled frame element.

As is evident from the illustration according to FIG. 4, the plug-type profile 3 of limbs 1*c* and 1*d* has a fin 6 extending vertically upwardly, against both sides of which the tiles 2 bear when paved. The fin 6 is provided with a groove 7, into which a rubber gasket 8 is inserted, as shown in FIG. 6 in cross-section. If required, the gasket 8 may be glued to the fin 6 of the limb in the region of the groove to prevent emergence of said gasket. Furthermore, provision is made for the gasket 8 to be manufactured in a color which goes well with the colors in the tiles. It is therefore not necessary for the frame itself to have a color suited to the color of the tiles.

The rubber gasket 8 is mushroom-shaped, the stem 8*a* of the gasket 8 being formed such that it fits in the groove 7 of the fin 6. The cap 8*b* is preferably trapezoidal and its height is such that its top edge approximately coincides with the top edge of a tile 2 when in its paved position in the frame, as illustrated in FIG. 2*b*.

Figure 3:
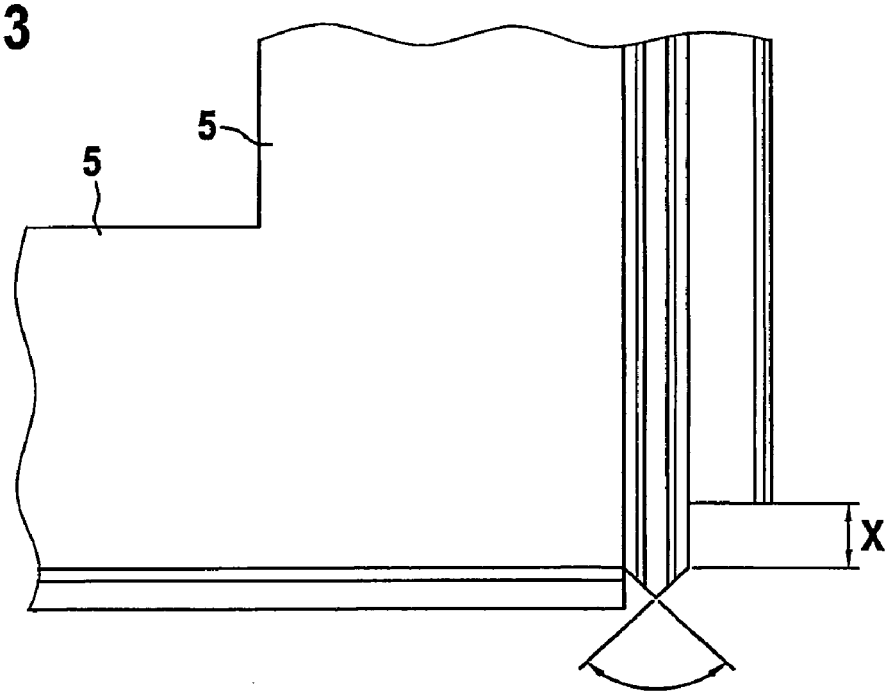
FIG. 3 is a top view on a corner of a paving frame.

The width of the rubber gasket 8 is greater than that of the fin 6 at least toward the upper end of the gasket, as a result of which the rubber gasket is pressed together when the tiles are in their paved position so that the gasket forms a gap seal. At the corners, 1*e* at the point of intersection of the tiles, the rubber gasket 8 is mitered at angles of 45° (FIG. 3), so that a seal is also obtained at the point of intersection.

The plug-type profile 3 (FIG. 4) has an extension 9, which cooperates with a snap-in groove 11 of corresponding shape in the socket-type profile 4 (FIG. 5). The two profiles 3 and 4 thus form a plug-and-socket framework by means of which a number of frames can be readily put together and, if desired, later readily separated from each other. To avoid problems which could occur when putting the parts together on site without the necessity of cutting, the extensions 9 of each frame with their locking cams 10 are disposed at a distance X from the outer edge of the frame.

Each tile 2 to be laid is provided with a frame such as is shown in FIG. 1. Preferably, the frame is adhesively bonded to the underside of the tile so that the tile and frame form a unit. This adhesive bonding has the further advantage that the tiles are firmly fixed in the paving and cannot emerge therefrom even when the finished paving is walked on for a long period of time.

Paving is carried out by placing the tiles and the frames adhering thereto on the prepared substrate to be paved (in the present case the floor coating) in such a manner that the limbs having the snap-in grooves 11 abut the limbs having the locking cam 10. The parts are forced (snapped) together to give a mechanical joint which can, if required, be disconnected later. When the parts are put together, the rubber gasket 8 is also pressed together, as described above, so that a certain degree of prestress is produced. This prestress ensures that an adequate seal against the penetration of dirt and moisture is obtained. It also compensates for tolerances in the paved tiles.

Figure 7:
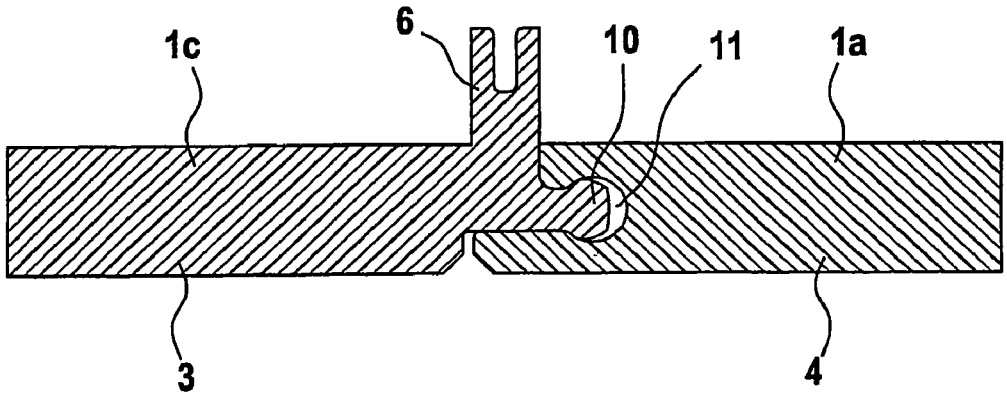
FIG. 7 shows another locking joint in cross-section.

FIG. 7 shows another locking joint, in which the locking cam 10 extending beyond the limb 1*c* has undercuts on its top and bottom sides, which engage a groove 11 on the receiving limb 1*a* that also has two undercuts. When the locking cam moves into the snap-in groove, the latter is forced apart and snaps back into its original position after the locking cam has been completely introduced and the side edge of the limb 1*a* has come to rest against the side edge or fin 6 of the limb 1*c*. The elasticity of the material used is such that this can be carried out non-destructively.

Figure 8:
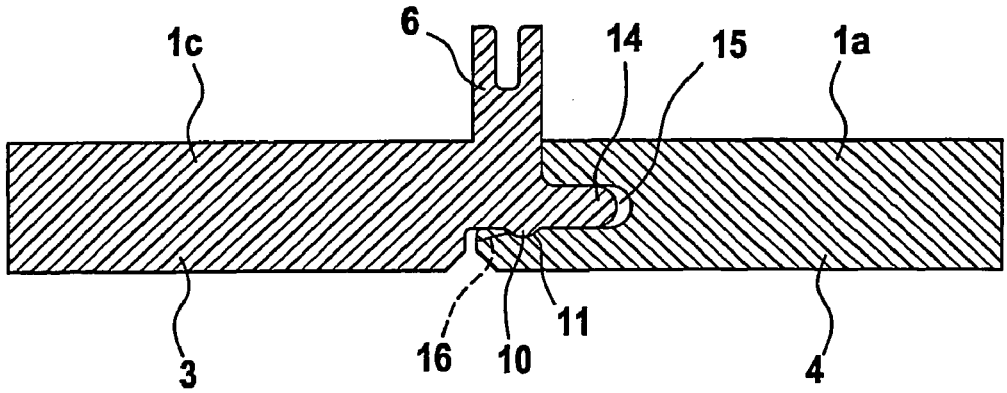
FIG. 8 shows yet another locking joint in cross-section.

In FIG. 8, the locking joint is itself free from undercuts in the region of a projection 14 and a groove 15 so that these parts are provided merely for guidance purposes. The parts are mechanically locked together via a locking cam 10 on the underside of the projection 14 and a locking groove 11 in the surface of the lower side wall of socket-type profile 4. For the purpose of facilitating assembly, an insertion bevel 16 can be provided, as indicated by the dashed line.

In FIGS. 4, 5, 7, and 8 it is particularly apparent that the female socket-type profile 4 engages under the male plug-type profile 3 on the underside thereof over a certain distance, which is equal to the width of the fin 6.

Figure 9:
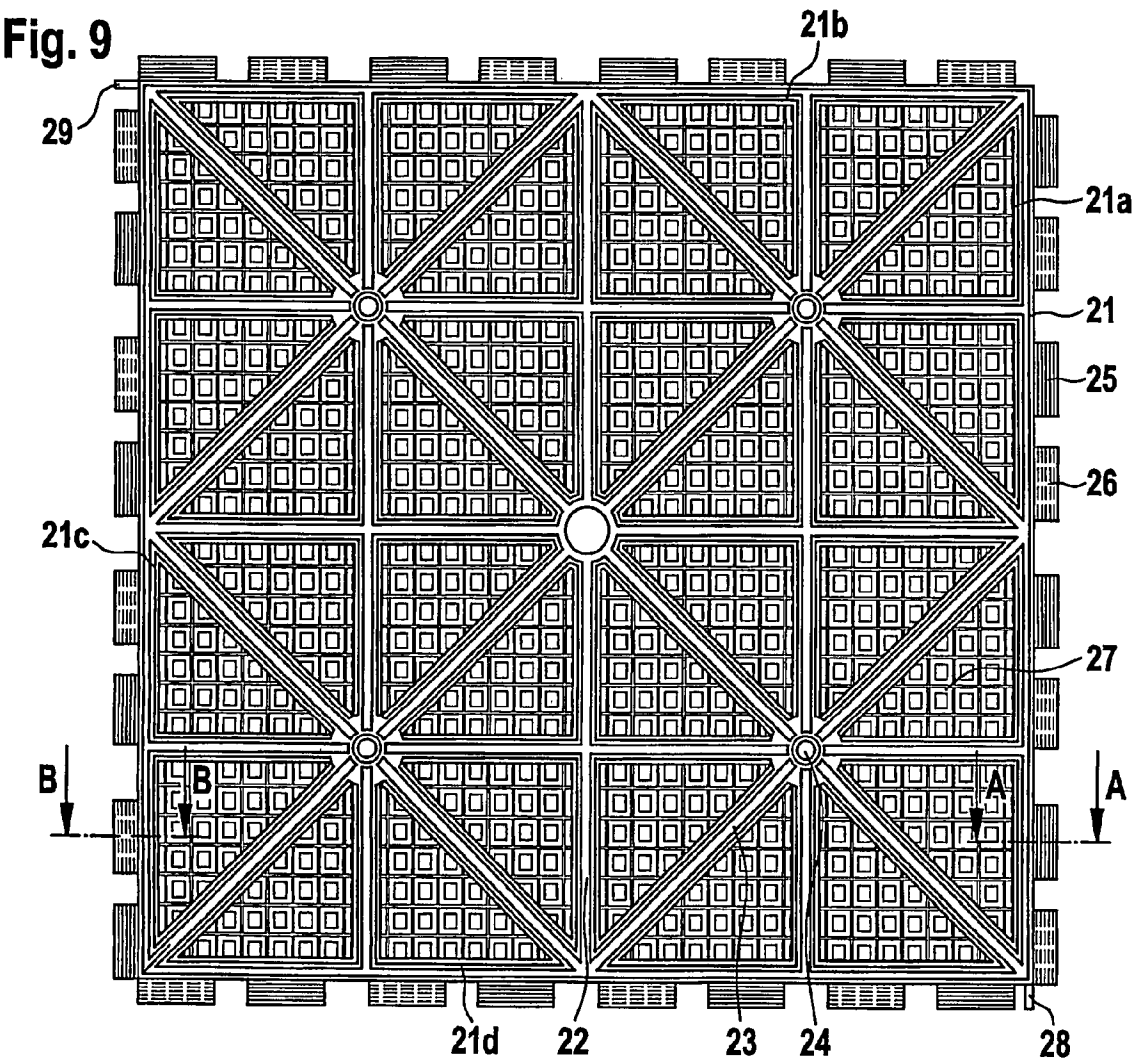
FIG. 9 shows another working example of a pre-formed frame for accommodation of a tile.

FIG. 9 shows another embodiment of the invention. In this case, a paving frame 21 consists not only of edge profiles 21*a, b, c*, and *d* at the edges but also of stiffening ribs 22, 23, of which a first group 22 runs parallel to the sides and a second group 23 diagonally thereto. The ribs 22, 23 intersect so that points of intersection 24 are formed. These points of intersection can be of different sizes.

On the edge profiles 21*a* to *d* there are formed top and bottom projections 25, 26 each of which represents one half of a locking joint, namely the upper or lower half respectively. This is described in greater detail below. Each paving area 27 bordered by ribs, edge profiles 21*a–d*, and the field delimited by 22, 23 has holes, indicated by dotted lines, whose function will be explained below.

Figure 10:
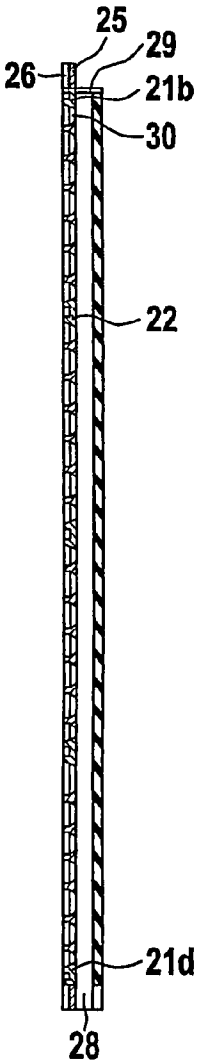
FIG. 10 is a cross-section through the floor tile shown in FIG. 9.

FIG. 10 is a cross-section through the paving frame shown in FIG. 9 and shows the lateral profiles 21*b*, 21*d* in the border area. Furthermore, it illustrates the course of fin 28. Starting from the profiles 21*a* to *d*, the fin 28 extends over almost the entire length or width of the tile frame 21, but only on two adjacent sides. This may be seen in FIG. 9 from the fin 28 disposed on the profile 21*a* and the fin 29 disposed on the adjacent profile 21*b*.

FIG. 10 likewise illustrates the holes 30 and also the inward ribs 22. Also visible are a top and bottom part 25, 26 of a locking joint.

Figure 11:
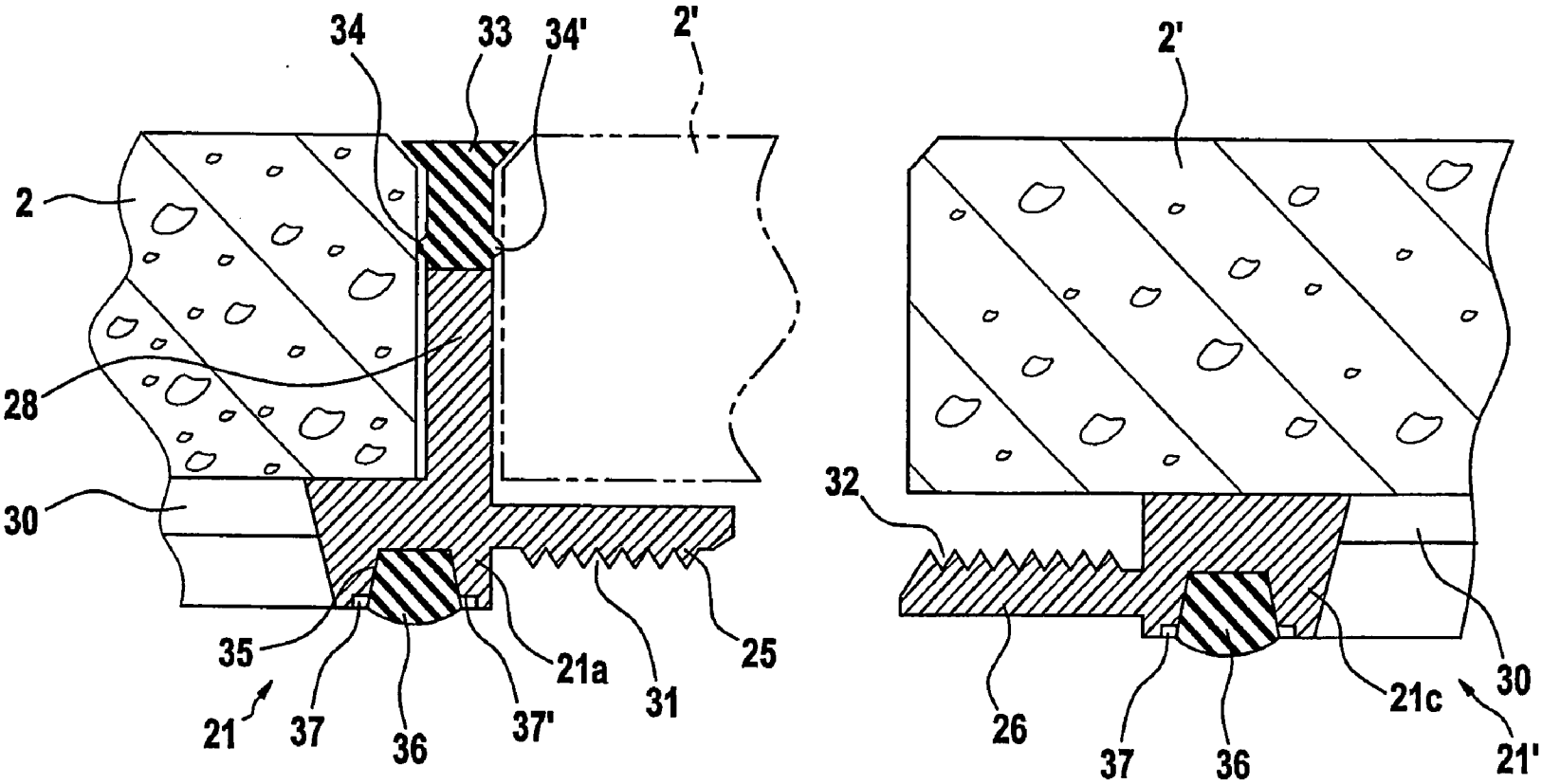
FIG. 11 shows another cross-section of the floor covering with two floor tiles to be laid.

The left-hand part of FIG. 11 is a cross-section taken along the line AA of FIG. 9, and the right-hand part of FIG. 11 corresponds to a neighboring tile according to the invention. First of all, the profiled frame element 21 having the edge profile 21*a* is illustrated, on which a tile 2 rests, this being fixed in position by the fin 28 acting as a stop.

The paving frame 21 is provided with holes 30, which will be explained below.

On the outside of the tile frame 21 there is visible an upper projection 25, which possesses downwardly directed catch teeth 31. The transition region of projection 25 toward the profiled frame element 21*a* is of resilient material so that the projection 25 can give way slightly.

In the right-hand part of FIG. 11, an adjacent floor tile is shown, whose marginal structure corresponds to the cross-section taken along line BB in FIG. 9. The tile 2' rests on the edge profile 21*c*, which possesses a lower projection 26 having catch teeth 32. The tile 2' extends over the lower projection 26 so that when the floor tiles 21, 21' are put together, the tile 2' overlaps the upper projection 25 of the edge profile 21*a*. On the left-hand side of FIG. 11, this state of installation is illustrated for the tile 2', in which case the lower projection 26 of the supporting profile 21*c* is beneath the upper projection 25 of the profiled frame element 21*a*. The upper projection 25 is thus enclosed on both sides. To enable the upper locking projection 25 to nevertheless slide over the catch teeth, it is positioned at a distance from the tile 2' such that the top side of the locking extension 25 is lower than the underside of tile 2' or the paving surface of tile 2.

The tiles 2, 2' are kept at a predefined minimum distance from each other by means of fin 28, whilst a gasket 33 mounted on fin 28 seals the tiles at their top surface. For this purpose, the gasket 33 is upwardly broadened in the form of a wedge and has sealing lips 34, 34' in the region of its shaft and extending toward the tiles 2 and 2' respectively. When the tiles are placed together, the inclined surfaces of the wedge-shaped end of the gasket 33 come to bear against correspondingly formed inclined surfaces on the tile 2, 2' and thus create a seal. If, however, moisture coming from, say, cleaning fluid, should penetrate beyond these seal faces, the sealing lips 34, 34' will prevent it from leaking down further.

In addition, the paving frame is provided on its underside with a groove 35, in which an insulating profile 36 is positioned. The insulating profile 36 projects beyond the lower edge of the profiled frame element 21*a* and can possess lateral compensating spaces 37, 37', which allow for deformation of the insulating profile 36 under load. Not only the supporting profiles 21*a* but also the stiffening ribs 22, 23 are provided with an insulating profile embedded in a groove so that good footfall-sound insulation is achieved.

Figure 12:
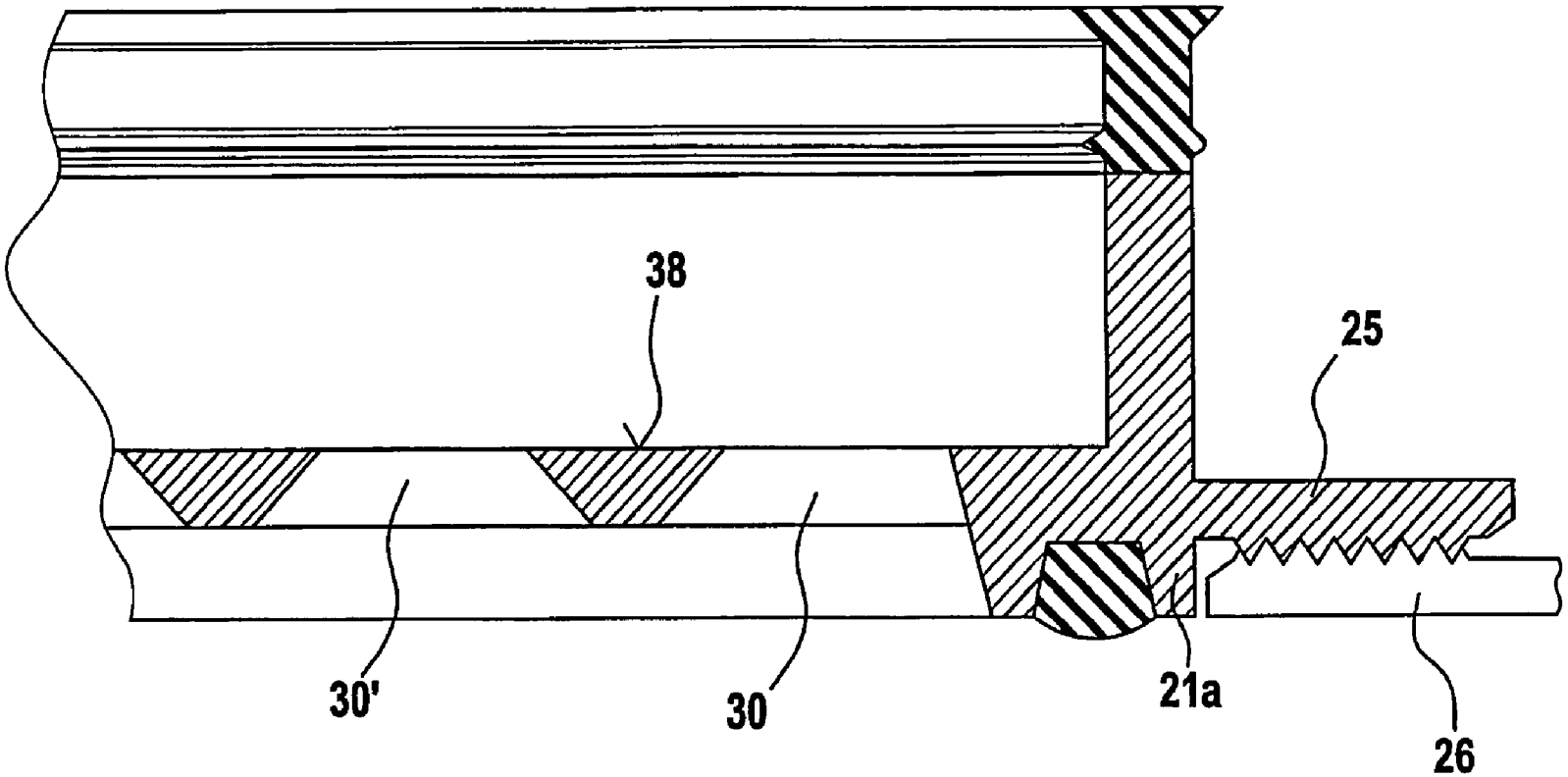
FIG. 12 is a cross-section of a partial enlargement of FIG. 9 with holes in the supporting surface.

FIG. 12 is likewise a cross-section taken along the line AA, but in this case the arrangement of the holes 30, 30' and the interposed supporting webs 38 of the paving region 27 is apparent. Of special significance is the inclination of the side walls of the webs 38 such that the hole 30 widens in the direction from the paving area for the tile toward the underside of the tile frame 21. This makes mechanical anchorage of the tile in the paving frame 21 possible by means of adhesive exuding through the hole 30. The tile (not shown) is by this means also mechanically fixed to the paving frame 21 since a pseudo-dovetail joint is formed.

The underside of the supporting webs 38 or the holes 30 is in spaced relationship to the underside of the supporting web 21*a*. The application of adhesive to the top side of the supporting web 38 is carried out, for example, mechanically by means of a doctor blade. Alternatively, only the rear side of the tile can be coated with adhesive, or both possibilities may be employed. It is not always necessary to glue the entire surface of the tile. In some cases it is sufficient to coat only partial areas with adhesive, and the adhesive may, if desired, be applied in the form of a bead of adhesive.

The adhesives used can be thermoplastic adhesives, so-called hot-melt glues, or else single-component or multi-component reactive adhesives, particularly polyurethane (PU) adhesives showing slight initial foaming.

In addition, FIG. 12 shows the upper and lower projections 25, 26 respectively, but the projections 25, 26 on the supporting profile 21*a* are not opposite to each other but are staggered back into the plane of the drawing by a certain distance, as is visible in FIG. 9. However, the interrelationship of the catch teeth is clearly shown here. At this juncture, reference may be made to the fact that the lower projection 26 also exhibits elasticity, to enable the catch teeth to slide past each other. An additional space for deflection is not provided in this case, however, since it is assumed that when it is desired to disconnect the joint it will be possible to lift the tile completely. Thus disconnection of the joint would even be possible if the upper locking projection should bear directly against the underside of the tile.

Figure 13:
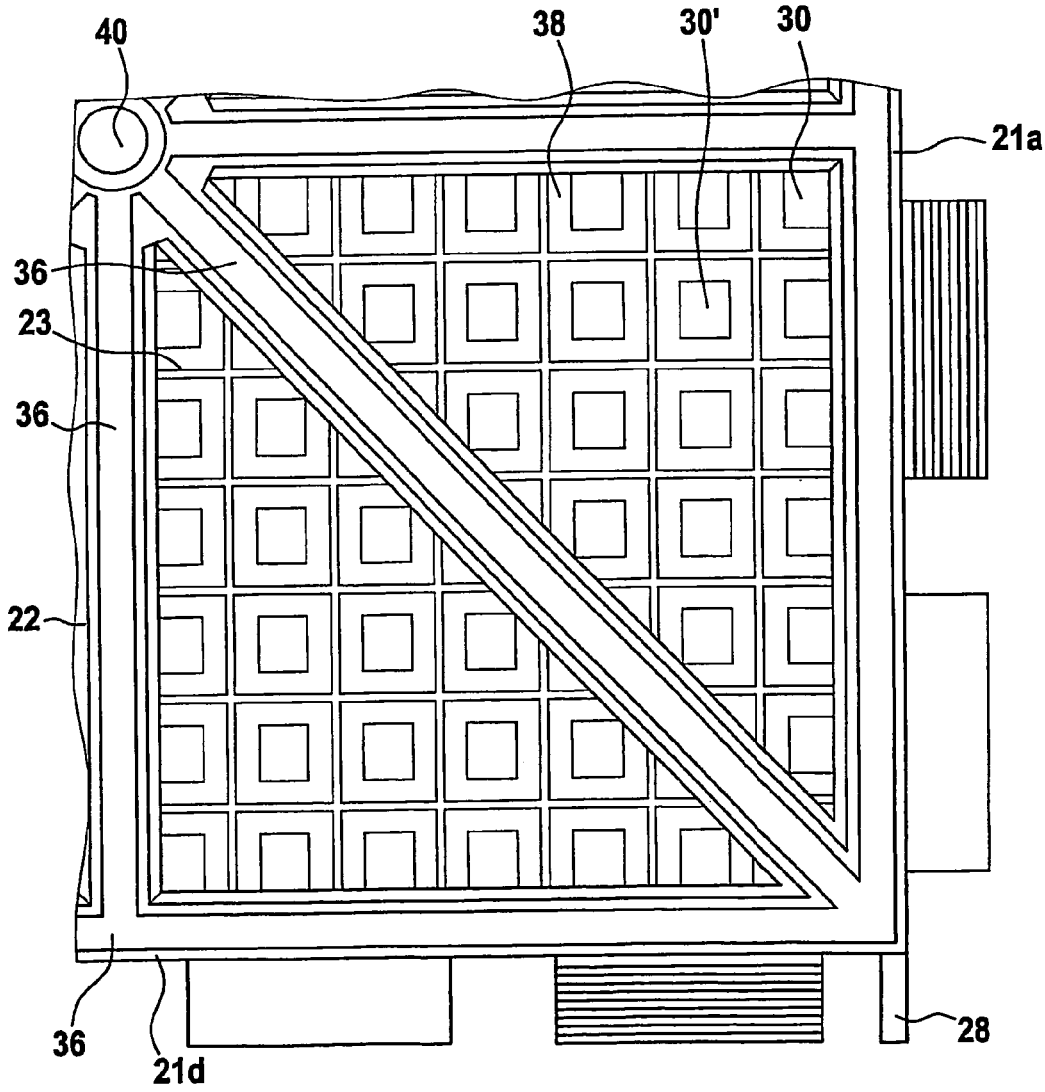
FIG. 13 is a partial enlargement of FIG. 9 as viewed from below.

FIG. 13 is a detail showing the right-hand lower corner of FIG. 9. The first point to notice here is the course of the edge profiles 21*a*, 21*d* and also the projecting fin 28 and a diagonal reinforcing rib 23 and also the reinforcing rib 22 running parallel to the supporting profile 21*a*. Both the supporting profiles 21*a*, 21*d* and the reinforcing ribs 22, 23 exhibit an insulating profile 36, which can be injection through a central injection feed point 40 in the region of the point of intersection 24 into the grooves 35 provided for this purpose, after the paving frame has been produced in a first injection molding process. The paving area between the edge profile 21*a* and the reinforcing rib 23 is provided with holes 30, 30', between which the supporting webs 38 extend.

Figure 14A:
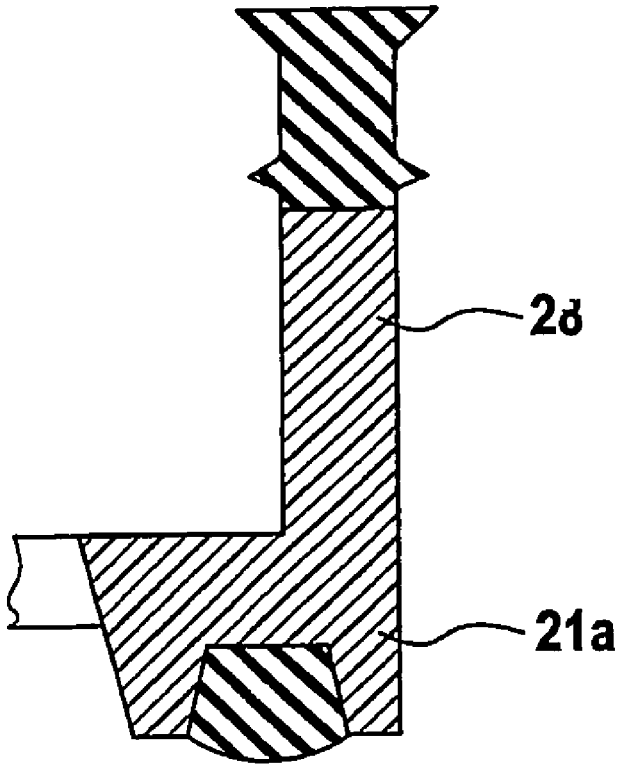
FIG. 14*a* is a cross-section through a partial enlargement of FIG. 9 showing a first supporting profile.
Figure 14B:
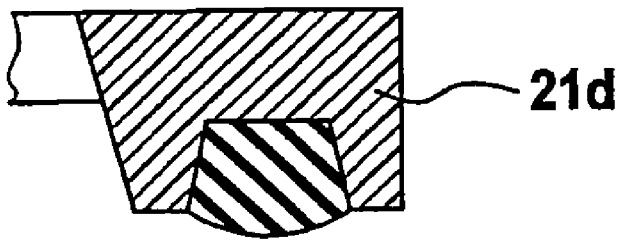
FIG. 14*b* is a cross-section of a partial enlargement of FIG. 9 showing a second supporting profile.

FIG. 14*a* again shows a cross-section through the supporting profile 21*a*, 21*d*, in which it is again apparent that exclusively the edge profile 21*a* is provided with the fin 28, which acts as a stop for the tile, whereas the supporting profile 21*d* exhibits no such fin.

Figure 15A:
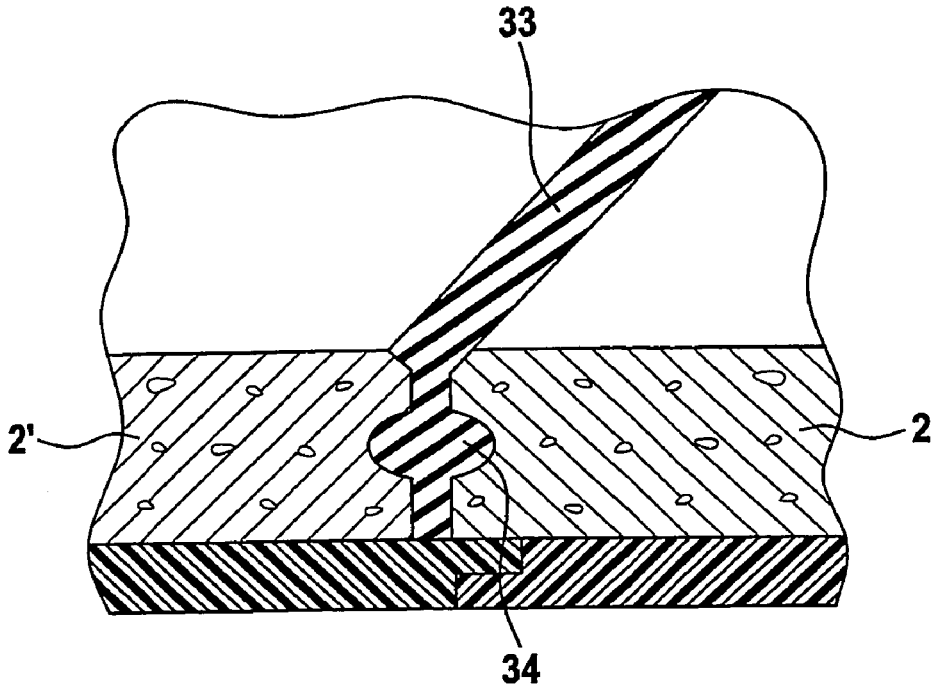
FIG. 15*a* shows a variant of the design of the gasket.
Figure 15B:
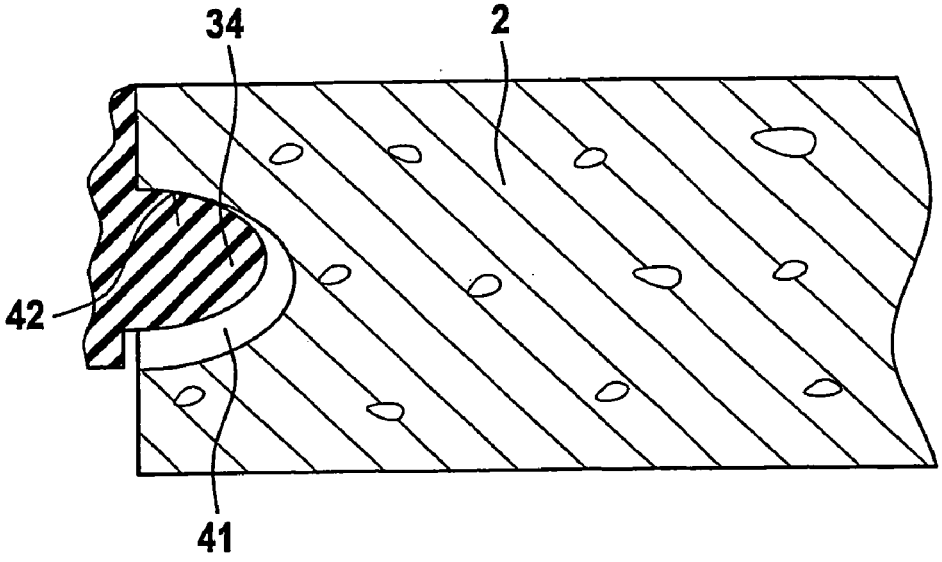
FIG. 15*b* shows the gasket in detail.

FIG. 15*a* shows a special embodiment of the gasket 33. Instead of the sealing lips illustrated in FIG. 11, sealing beads 34 are provided, which project into a groove in the edge of the tile 2, 2'. The detailed view shown in FIG. 15*b* illustrates how the groove 41 may indeed be larger than the sealing bead 34 provided that a good seal is produced over at least part thereof. Thus a seal face 42 is obtained.

As mentioned above, connection of the tile to the paving frame is achieved using, for example, a bonding technique. This may involve applying hot-setting adhesive or a curable adhesive substance such that the adhesive substance passes through the conically widening holes 30 to effect mechanical anchorage. On the paving area between the holes there is a normal adhesive joint so that the tile is fixed in position, after the adhesive has cured, both via the adhesive joint and via said mechanical anchorage similar to a dovetail joint.

The paving frame can be provided, via a two-component injection molding process, with the thermoplastic elastomer required for the gasket 33 to give the footfall-sound-insulation 36, and the frame itself can be of a rigid plastics material such as polystyrene or polyurethane, whilst the footfall-sound-insulating material used may be a thermoplastic elastomer TPE.

In addition, the catch teeth can be in the form of a single projection so that locking is achieved by only one tooth, or, as in the working example, in the form of a plurality of catch teeth so that multilocking is achieved and any dimensional differences can be compensated for. The locking joint should be in such a form that disconnection is possible by reason of the lever action resulting from lifting the tile at the opposite edge. When paved tiles are subjected to a purely tensile load, disconnection thereof should, on the other hand, only be possible after exceeding the load normally employed.

The one-sided locking joint of the second working example has the advantage that the overall height is even more reduced than when a pin-and-socket connector is used.

The footfall-sound-insulating material is included in the paving area, 1*e*, in the working example, in the reinforcing ribs 22, 23 and the edge profiles 21*a* to *d*. Here again, a low overall height can be obtained. The footfall-sound-insulating material can be such that an antislip action is additionally achieved.

The floor tile composed of a tile and a paving frame has, due to the adhesive joint, increased static stability, so that the necessary thickness of the tile can, in the case of granite flagstones, be reduced from hitherto 10 mm to 8 mm or even down to 6 mm. This leads to a considerable economy of material and thus to reduced costs for the production of a floor covering.

As mentioned above, the insulating profile 36 projects beyond the underside of the edge profiles 21*a–d* or of the reinforcing ribs 22, 23, and the underside of the supporting profiles or reinforcing ribs also bears against the floor, however, when subjected to extreme load and thus prevents destruction of the footfall-sound-insulating material. Thus the footfall-sound-insulating material let into a groove is protected from damage under extreme load.

The adhesive used should be one capable of ensuring sufficient thermal stability when use is made of underfloor heating units. When paving is to be carried out outdoors, the adhesive must be weather-resistant.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A paving system for making a floor covering of tiles, wherein each tile rests over at least part of a surface of its underside on a paving frame exhibiting edge profiles having paving regions, and the paving frame exhibits a fin projecting beyond the paving surface toward a top side of the tile, which extends at least in part along an edge of the tile in direction of the top side of the tile, wherein the paving frames are interconnectable, and wherein the fin is provided only on two adjacent first supporting profiles, whereas the other two second supporting profiles exhibit a paving region having no fin and of which the first supporting profiles exhibit at least one locking extension projecting beyond the tile, whilst the two other second supporting profiles have at least one locking extension situated below the tile and in each case said first supporting profiles cooperate with different said second supporting profiles.

2. A paving system as defined in claim 1, wherein on the fin there is formed a profiled sealing paving strip which extends along the edge of the tile toward the top side of the tile.

3. A paving system as defined in claim 1, wherein the paving frame and the tile form a unit.

4. A paving system as defined in claim 1, wherein the paving frame is provided on its underside with a footfall-sound-insulating material.

5. A paving system as defined in claim 4, wherein the paving frame exhibits footfall-sound-insulating material under the paving area.

6. A tile, designed for use in a paving system as defined in claim 1.

7. A floor covering, made with tiles as defined in claim 6.

8. A paving frame for tiles to be used in a paving system as defined in claim 1.

9. A paving frame as defined in claim 8, further comprising a gasket attached to the fin.

10. A paving frame as defined in claim 9, wherein a groove is provided in the fin and in which the gasket can be inserted.

11. A paving frame as defined in claim 8, wherein the paving frame is provide on its underside with an insulating profile, which insulating profile is accommodated in a groove.

12. A paving frame as defined in claim 8, wherein the paving frame exhibits reinforcing ribs and a paving surface having holes and that the reinforcing ribs are provided on their underside with a groove for accommodation of an insulating profile.

13. A paving frame as defined in claim 12, wherein the holes in the paving surface widen conically starting from the region of the tile.

14. A paving frame as defined in claim 8, wherein the paving frame is pre-formed as a single unit.

15. A paving frame as defined in claim 8, wherein the paving frame is composed of interconnected profiles.

16. A paving frame as defined in claim 9, wherein the gasket on the one hand and an insulating profile on the other hand are materially united with the frame.

17. A paving frame as defined in claim 1, wherein the paving frame is composed of four edge profiles provided with a paving strip for a tile, of which two edge profiles exhibit at least one projection extending beyond the tile, whilst the other two edge profiles exhibit at least one projection situated under the tile and one edge profile cooperates with a different edge profile.

18. A paving system for making a floor covering of tiles, said system comprising at least one tile resting over at least part of a surface of an underside thereof on a paving frame including edge profiles having paving regions, said paving frame including a fin projecting beyond the paving surface toward a top side of the tile, said fin extending at least partially along an edge of the tile in direction of the top side of the tile, said paving frame including first and second sets of supporting profiles, and wherein the fin is provided only on two adjacent said first supporting profiles, whereas other two said second supporting profiles include a paving region having no fin and of which the first supporting profiles include at least one locking extension projecting beyond the tile, whilst the two second second supporting profiles have at least one locking extension situated below the tile and in each case said first supporting profiles cooperate with said second supporting profiles, said fin including paving means extending along the edge of the tile toward the top side of the tile.

19. A paving system as defined in claim 18, wherein said paving means includes a profiled sealing paving strip.

20. A paving frame as defined in claim 18, wherein said paving means is formed of rubber-elastic material attached to said fin.

21. A paving frame as defined in claim 18, wherein a groove is provided in said fin for insertion of said paving means therein.

22. A paving system as defined in claim 1, wherein the paving frame and the tile form a unit and are bonded to each other.

23. A paving frame as defined in claim 8, further comprising a gasket of rubber-elastic material attached to the fin.

24. A paving frame as defined in claim 8, wherein the paving frame is composed of interconnected profiles, said profiles being extruded profiles.

25. A paving frame as defined in claim 9, wherein the gasket on the one hand and an insulating profile on the other hand are materially united with the frame by injection molding.

* * * * *